United States Patent [19]

Hirose et al.

[11] 4,354,797

[45] Oct. 19, 1982

[54] FRONT LOADING HYDRAULIC EXCAVATOR

[75] Inventors: Kiyonobu Hirose, Ibaraki; Taizo Izumiyama, Toride, both of Japan

[73] Assignee: Hitachi Construction Machinery Co., Ltd., Tokyo, Japan

[21] Appl. No.: 154,278

[22] Filed: May 29, 1980

[30] Foreign Application Priority Data

May 31, 1979 [JP] Japan ..... 54-67716
May 31, 1979 [JP] Japan ..... 54-67717

[51] Int. Cl.[3] ..... E02F 3/86

[52] U.S. Cl. ..... 414/700; 91/512; 91/517

[58] Field of Search ..... 414/700, 699, 694; 91/388, 512, 517, 518

[56] References Cited

U.S. PATENT DOCUMENTS 3,563,137 2/1971 Graber et al. ..... 414/700 X
3,862,697 1/1975 Gill et al. ..... 414/700
3,905,500 9/1975 Bourges ..... 414/699
3,987,920 10/1976 Parquet et al. ..... 414/700

FOREIGN PATENT DOCUMENTS 49-52404 5/1974 Japan .

*Primary Examiner*—Bruce H. Stoner, Jr.
*Attorney, Agent, or Firm*—Antonelli, Terry & Wands

[57] ABSTRACT

An excavator including a boom pivotally moved by boom cylinders, an arm pivotally moved by an arm cylinder and a bucket pivotally moved by bucket cylinders further includes a boom detecting device detecting a pivotal displacement of the boom and producing a first pilot pressure substantially proportional to the pivotal displacement of the boom and a bucket detecting device detecting a pivotal displacement of the bucket and producing a second pilot pressure substantially proportional to the pivotal displacement of the bucket. The first pilot pressure is supplied via a first conduit to a first valve switching pilot pressure port of a control valve device, and the second pilot pressure is supplied via a second conduit to a second valve switching pilot pressure port of the control valve device. The control valve device is connected to the bucket cylinders in such a manner that a piston side of the bucket cylinders can be drained.

8 Claims, 14 Drawing Figures

FRONT LOADING HYDRAULIC EXCAVATOR

BACKGROUND OF THE INVENTION

This invention relates to an excavator having a boom, an arm and a bucket.

In one type of excavator known in the art, a link mechanism in the form of a parallelogram is utilized for maintaining the bucket in a predetermined posture when the bucket is pushed out horizontally.

In this type of excavator, when the earth scooped by the bucket is dumped, the boom is pivotally moved upwardly to a height sufficiently great to dump the earth from the bucket that has been scooped. At this time, the bucket tilts rearwardly as the boom is pivotally moved upwardly, so that there is the danger that the earth may be spilled into the cab. To avoid this danger and also to prepare the excavator for an earth dumping operation, it has hitherto been necessary to perform a complicated operation of pivotally moving the bucket forwardly simultaneously as the boom is pivotally moved upwardly. Various proposals have been made for automatically maintaining the bucket in a predetermined posture when the boom is pivotally moved upwardly to a height sufficiently great to dump the earth, to avoid the problem of the earth being spilled into the cab. One of such proposals is disclosed, for example, in Japanese Patent Application Laid-Open No. 52404/74.

The excavator described in Japanese Patent Application Laid-Open No. 52404/74 includes a master cylinder interposed between the swivelling member and the boom and connected to bucket cylinders via conduits, so that when the boom is pivotally moved upwardly the master cylinder expands to supply hydraulic fluid from the master cylinder to the bucket cylinders to keep the bucket in a predetermined posture.

The following problems have been raised in the excavator of this construction. First, when boom cylinders contract with the bucket in an upper vertical posture position, the master cylinder also contracts and the hydraulic fluid on the bottom side of the master cylinder is introduced into the bucket cylinders via the line, to thereby expand the bucket cylinders. This pivotally moves the bucket rearwardly to a lower vertical posture position. To return the bucket from this position to a horizontal position or an excavation initiating position requires contraction of an arm cylinder. However, a slight contraction of the arm cylinder brings the upper surface of the arm into contact with the back of the bucket. If contraction of the arm cylinder is continued in this condition, the arm cylinder would force the bucket cylinders to contract, so that the time required for this operation would be prolonged and operation efficiency would be reduced. In place of allowing the arm cylinder to force the bucket cylinders to contract, the boom may be pivotally moved downwardly and the bucket may be pivotally moved forwardly. In such case, it is necessary to perform a bucket forward pivoting operation in addition to boom lowering, arm lowering and swivelling operations. This would unnecessarily increase the strain to which the operator is subjected.

Secondly, mounting the master cylinder requires increased strength of the swivelling member and the boom which increases production cost. Also, to connect the master cylinder and the arm cylinder to the lower portion of the boom, it is necessary to mount the master cylinder and the arm cylinder in such a manner that they are displaced sideways to ensure that they do not strike each other. In this construction, a high twisting force would act on the boom due to the thrusts of high magnitude produced by the master cylinder and the arm cylinder. Thus, it would be necessary to increase the strength of the boom by rendering its construction sturdy. This means an increase in the weight of the boom and leads to an increase in production cost. An increase in the weight of the boom makes it imperative to reduce the capacity of the bucket, to avoid an increase in the overall weight of the excavator. Thus the result is a reduction in the performance of the excavator.

Thirdly, when the bucket scoops earth as it is pivotally moved rearwardly while the boom is pivotally moved upwardly, the master cylinder expands as the boom moves upwardly. As a result, part of the hydraulic fluid which should be supplied to the bucket cylinders from a hydraulic pump is introduced into the bottom side of the master cylinder via one of the conduits. Thus, actuation of the bucket cylinders takes more time than is necessary due to its low operation speed, thereby causing a reduction in operation efficiency.

Fourthly, when the bucket is of the tilt-dump type, it is necessary that the bucket be pivotally moved forwardly in its upper vertical posture position to dump earth from the bucket. If the bucket is moved pivotally rearwardly by misoperation, there would be the danger that the earth in the bucket would be dumped into the cab.

The construction of the excavator of the prior art described hereinabove and the problems encountered in the construction and operation of this type of excavator are subsequently to be described by referring to the drawings.

SUMMARY OF THE INVENTION

The aim underlying the present invention essentially resides in avoiding the aforesaid problems experienced in the prior art.

Accordingly, the primary object of the present invention is to provide an excavator which is capable of automatically maintaining the bucket in a predetermined posture when the bucket is moved upwardly after scooping earth, which is capable of returning the bucket to an excavation initiating position readily and quickly following earth dumping, and which has high operation efficiency, simple construction, light weight and compact size and are manufactured in low cost.

The secondary object of the present invention is to provide an excavator which is capable of preventing the bucket from being pivotally moved rearwardly when the operator commits an error in the operation of dumping earth from the bucket.

According to the invention, there is provided an excavator comprising a swivelling member mounted for swivelling motion on a travelling member, a boom pivotally moved by boom cylinders pivotally connected to the swivelling member, an arm pivotally moved by an arm cylinder pivotally connected to the boom and a bucket pivotally moved by bucket cylinders pivotally connected to the arm, wherein the improvement comprises boom detecting means for detecting a pivotal displacement of the boom and producing a first pilot pressure substantially proportional to the detected pivotal displacement of the boom, bucket detecting means for detecting a pivotal displacement of the bucket and producing a second pilot pressure substantially proportional to the detected pivotal displacement of the bucket, control valve means including first and second valve switching pilot pressure ports, a first conduit means for introducing the first pilot pressure to the first valve switching pilot pressure port of the control valve means, and a second conduit means for introducing the second pilot pressure to the second valve switching pilot pressure port of the control valve means, said control valve means being connected to the bucket cylinders in such a manner as to allow the piston side of the bucket cylinders to be drained.

DESCRIPTION OF THE PREFERRED EMBODIMENTS

Figure 1:
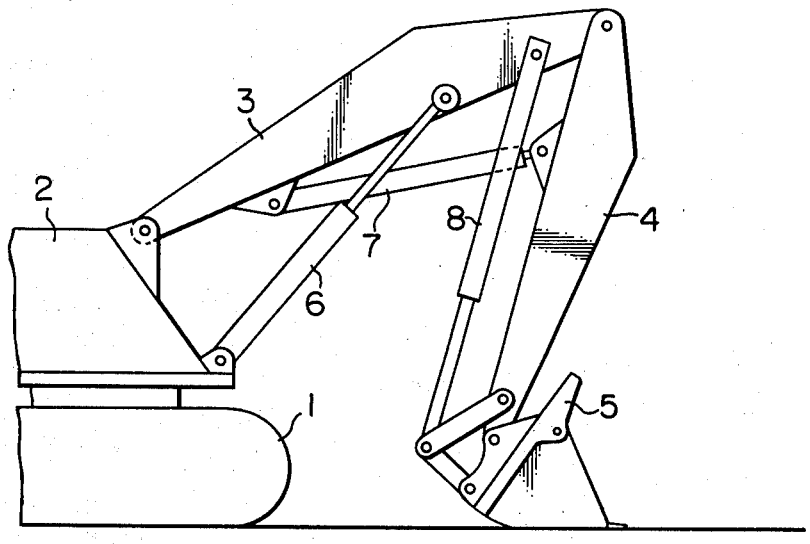
FIG. 1 PRIOR ART
FIG. 1 is a side view of an excavator of the prior art.

To enable the advantages offered by the invention to be clearly understood, the prior art and the problem encountered in the prior art will be first described by referring to the drawings, before describing in detail the embodiments of the invention.

FIG. 1 shows the excavator of the prior art discussed in the background of the invention, which comprises a travelling member 1, a swivelling member 2 mounted on the travelling member 1 for swivelling motion, a boom 3 pivotally connected to the swivelling member 2, an arm 4 pivotally connected to the boom 3, a bucket 5 of the bottom-dump type pivotally supported by the arm 4, boom cylinders 6 for pivotally moving the boom 3, an arm cylinder 7 for pivotally moving the arm 4 and bucket cylinders 8 for pivotally moving the bucket 5.

A bucket operation cycle of the excavator of the type shown in FIG. 1 includes a series of operations of pushing out the bucket 5 horizontally from the position shown, pivotally moving the bucket 5 to scoop earth, moving the bucket 5 upwardly to an earth dumping position and returning the bucket to the illustrated position.

In performing the operation of moving the boom 3 upwardly to a height sufficiently great to allow the earth in the bucket 5 to be dumped, the boom is pivotally moved upwardly and at the same time the bucket 5 is pivotally moved rearwardly (counterclockwise in FIG. 1). Thus, there is the danger that the earth may be spilled into the cab. To avoid this danger and also to prepare the bucket 5 for dumping earth, it is necessary to operate the excavator in a complicated process to pivotally move the bucket 5 forwardly simultaneously as the boom 3 is pivotally moved upwardly. To avoid this problem, various proposals have been made for automatically maintaining the bucket 5 in a predetermined posture when it is moved upwardly to a height great enough to dump earth. One of such proposals is disclosed, for example, in Japanese Patent Application Laid-Open No. 52404/74.

Figure 2:
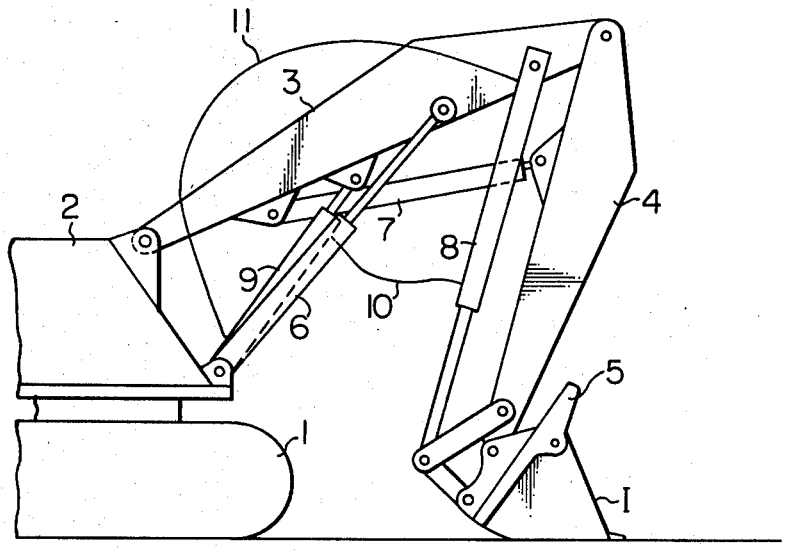
FIG. 2 PRIOR ART
FIG. 2 is a side view of another excavator of the prior art.

FIG. 2 shows the excavator described in Japanese Patent Application Laid-Open No. 52404/74 in which parts similar to those shown in FIG. 1 are designated by like reference characters. The excavator shown in FIG. 2 comprises, in addition to those members which are similar to those shown in FIG. 1, a master cylinder 9 interposed between the swivelling member 2 and the boom 3, a conduit 10 connecting the rod side of the master cylinder 9 to the rod side of the bucket cylinders 8 and a conduit 11 connecting the piston side of the master cylinder 9 to the piston side of the bucket cylinders 8.

In this type of excavator, the bucket 5 is in a lower horizontal posture position I on the ground which is an excavation initiating position as shown in FIG. 2. From this position, the bucket 5 is pushed out horizontally forwardly as the arm cylinder 7 is expanded and the boom cylinders 6 are expanded or contracted, until the bucket 5 is moved to a lower horizontal posture position II shown in dash-and-dot lines in FIG. 3. Then the bucket cylinders 8 are expanded to move the bucket 5 to a lower vertical posture position III shown in solid lines in FIG. 3, to scoop earth 12 by the bucket 5. Thereafter the boom cylinders 6 are expanded to pivotally move the boom 3 upwardly. Upward pivotal movement of the boom 3 causes the master cylinder 9 to expand, so that the hydraulic fluid on the rod side of the master cylinder 9 is supplied via the conduit 10 to rod side of the bucket cylinders 8. As the bucket cylinders 8 contract, the bucket 5 is pivotally moved forwardly into an upper vertical posture position IV. That is, since the bucket 5 is automatically moved pivotally forwardly when the boom 3 is pivotally moved upwardly while the bucket 5 is in position IV, it is possible to avoid the earth in the bucket 5 being spilled rearwardly without the need to perform the complicated operation required in the prior art.

Figure 3:
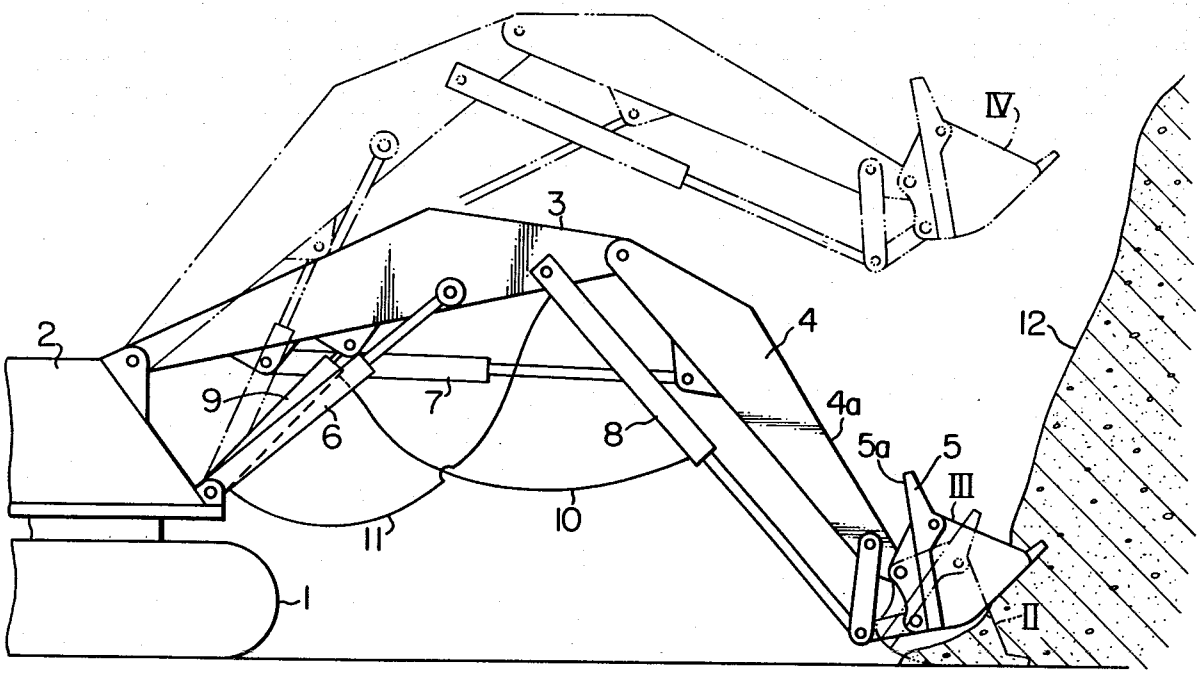
FIG. 3 PRIOR ART
FIG. 3 is a side view of the excavator shown in FIG. 2, showing the excavator in performing operations.

However, the excavator shown in FIGS. 2 and 3 has the following problems. First, when the boom cylinders 6 contract with the bucket 5 in the upper vertical posture position IV, the master cylinder 9 also contracts and the hydraulic fluid on the bottom side of the master cylinder 9 is introduced into the piston side of the bucket cylinders 8 via the conduit 11, to thereby expand the bucket cylinders 8. This pivotally moves the bucket 5 rearwardly to the lower vertical posture position III. To return the bucket 5 from this position to the horizontal posture position I or the excavation initiating position requires contraction of the arm cylinder 7. However, a slight contraction of the arm cylinder 7 brings an upper surface of the arm 4 into contact with the undersurface 5a of the bucket 5. If contraction of the arm cylinder is continued in this condition, the arm cylinder 7 would force the bucket cylinders 8 to contract, so that the time required for this operation would be prolonged and operation efficiency would be reduced. In place of allowing the arm cylinder 7 to force the bucket cylinders 8 to contract, the boom 3 may be pivotally moved downwardly and the bucket 5 may be pivotally moved forwardly. In such case, it is necessary to perform a bucket forward pivoting operation in addition to boom lowering, arm lowering and swivelling operations. This would unnecessarily increase the strain to which the operator is subjected.

Secondly, mounting the master cylinder 9 requires increased strength of the swivelling member 2 and the boom 3 which increases production cost. Also, to connect the master cylinder 9 and the arm cylinder 7 to the lower portion of the boom 3, it is necessary to mount the master cylinder 9 and the arm cylinder 7 in such a manner that they are displaced sideways to ensure that they do not strike each other. In this construction, a high twisting force would act on the boom 3 due to the thrusts of high magnitude produced by the master cylinder 9 and the arm cylinder 7. Thus, it would be necessary to increase the strength of the boom 3 by rendering its construction sturdy. This means an increase in the weight of the boom 3 and leads to an increase in production cost. An increase in the weight of the boom 3 makes it imperative to reduce the capacity of the bucket 5, to avoid an increase in the overall weight of the excavator. Thus, the result is a reduction in the performance of the machine.

Figure 4:
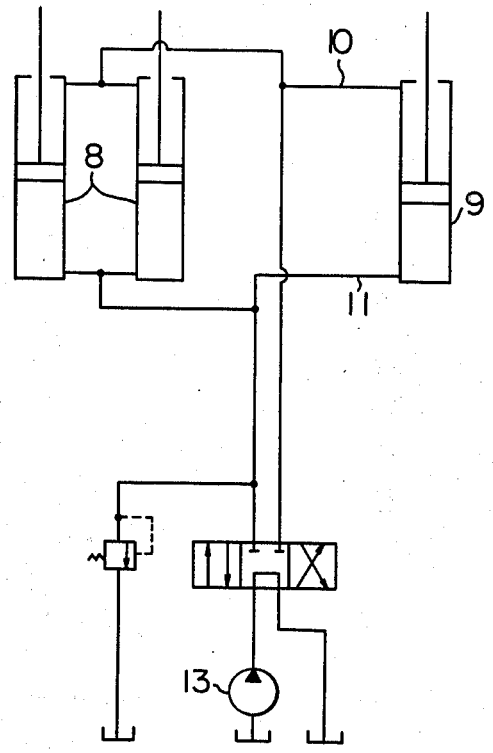
FIG. 4 PRIOR ART
FIG. 4 shows a part of a hydraulic fluid circuit of the excavator shown in FIG. 2.

Thirdly, when the bucket 5 scoops earth as it is pivotally moved rearwardly while the boom 3 is pivotally moved upwardly, the master cylinder 9 expands as the boom 3 moves upwardly. As a result, part of the hydraulic fluid which should be supplied to the bucket cylinders 8 from a hydraulic pump 13 is introduced into the bottom side of the master cylinder 9 via the conduit 11 as shown in FIG. 4. Thus actuation of the bucket cylinders 8 takes more time than is necessary due to their slow operation speed, thereby reducing operation efficiency.

Fourthly, when the bucket 5 is of the tilt-dump type, it is necessary that the bucket 5 be moved pivotally forwardly when it is in position IV, to dump the earth. If the bucket 5 is moved pivotally rearwardly by misoperation, there would be the danger that the earth in the bucket 5 is dumped into the cab.

The present invention provides a novel excavator which avoids all the aforesaid problems raised in the prior art. Features and advantages of the invention will become apparent from the description of the embodiments set forth hereinafter.

Figure 5:
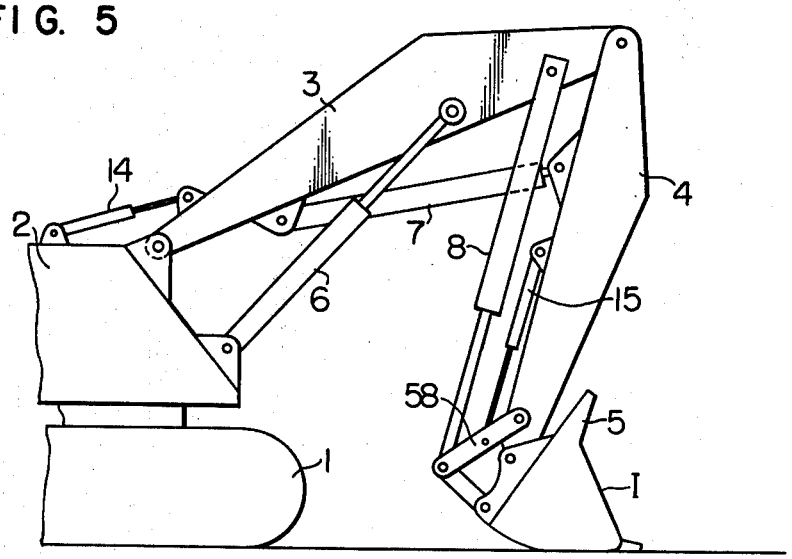
FIG. 5 is a side view of the excavator comprising a first embodiment of the invention.

FIG. 5 shows a first embodiment of the invention in which parts similar to those shown in FIGS. 1 and 2 illustrating an excavator of the prior art are designated by like reference characters. For the convenience of explanation, the bucket 5 selected is of the tilt-dump type.

In FIG. 5, there is shown a cylinder 14 respectively connected through pins at opposite ends thereof to the swivelling member 2 and the boom 3. In the illustrated embodiment, the cylinder 14 constitutes a part of boom detecting means presently to be described. There is also shown a cylinder 15 respectively connected through pins at opposite ends thereof to the arm 4 and a link 58. In the illustrated embodiment, the cylinder 15 constitutes a part of bucket detecting means subsequently to be described.

Figure 6:
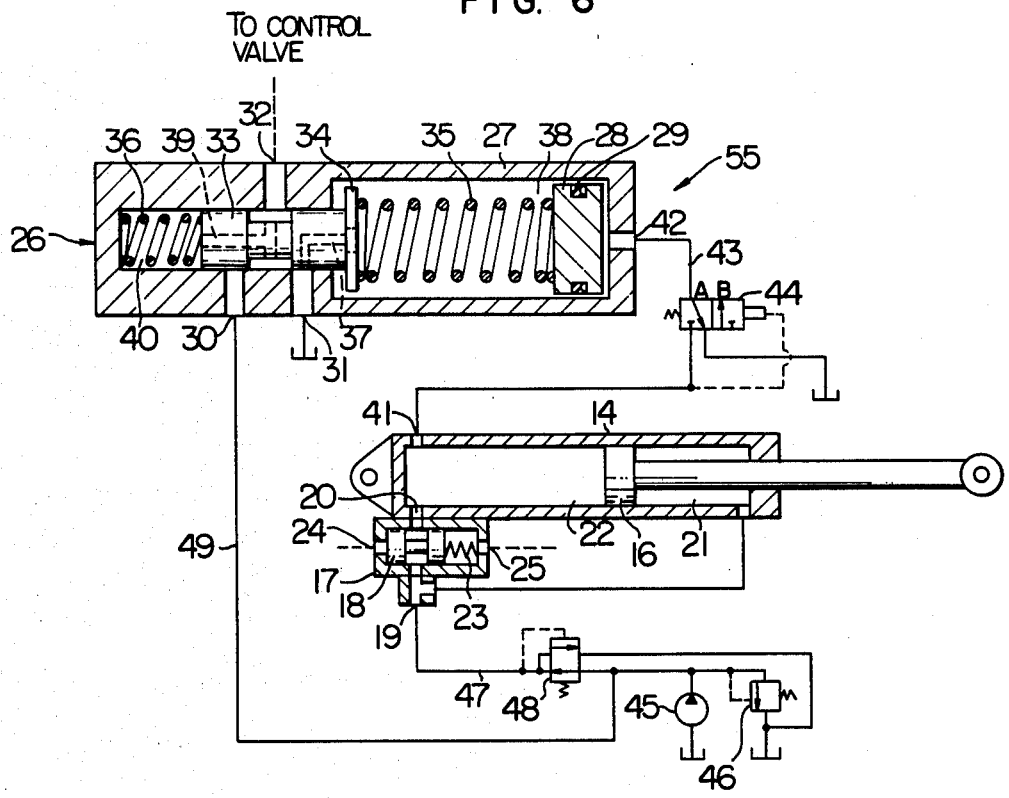
FIG. 6 is a sectional view of the boom detecting means of the excavator shown in FIG. 5.

In FIG. 6, the boom detecting means generally designated by the reference numeral 55 includes the cylinder 14 having a piston 16 fitted therein and a change-over valve 17 mounted thereon including a spool 18, with the change over valve 17 being formed with ports 19 and 20. The port 19 communicates with a chamber 21 formed on the rod side of the cylinder 14, and the port 20 communicates with a chamber 22 formed on the piston side of the cylinder 14. The change-over valve 17 also includes a spring 23 mounted therein for urging the spool 18 leftwardly in FIG. 6 by its biasing force, with the change over valve 17 also being formed with pilot pressure ports 24 and 25. When a pilot pressure is applied by manipulation of the operator to a boom operating valve 52 (See FIG. 7) for pivotally moving the boom 3 upwardly, the pilot pressure is simultaneously applied to the pilot pressure port 24, and when a pilot pressure is applied by manipulation of the operator to a bucket operating valve 54 (See FIG. 7) for pivotally moving the bucket 5 rearwardly, the pilot pressure is simultaneously applied to the pilot pressure port 25. The arrangement may be modified so that also when a pilot pressure is applied by manipulation of the operator to the bucket operating valve 54 for pivotally moving the bucket 5 forwardly, the pilot pressure is simultaneously applied to the pilot pressure port 25 as well.

Pressure producing means generally designated by the reference numeral 26 includes a cylinder 27, a piston 28 slidably fitted in the cylinder 27, a seal 29 mounted on the piston 28, a pump port 30, a tank port 31 and an output port 32 formed in the cylinder 27, a spool 33 slidably fitted in the cylinder 27, a spring seat 34 attached to the spool 33, a spring 35 mounted between the spring seat 34 and the piston 28, a spring 36 mounted between the spool 33 and an end of the cylinder 27, a hydraulic fluid passage 37 communicating a spring chamber 38 with the tank port 31, a hydraulic fluid passage 39 communicating a spring chamber 40 with the output port 32, and a port 42 formed in the cylinder 27. A port 41 formed in the cylinder 14, is connected to the port 42 via a conduit 43 mounting a change-over valve 44. The change-over valve 44 is normally in position A or a closed position and switched to position B or an open position when a pressure of a value higher than the predetermined level is produced at the port 41. An auxiliary pump 45, having a relief valve 46 connected thereto, communicates with the port 19 of the change-over valve 17 via a conduit 47 in which is arranged a pressure reducing valve 48. The auxiliary pump 45 is connected to the pump port 30 of the pressure reducing means 26 via a conduit 49.

In the boom detecting means 55 of the aforesaid construction, the pilot pressure is applied to the port 25 of the change-over valve 17 and the spool 18 is moved leftwardly in FIG. 6 to allow the port 19 to communicate with the port 20, when the bucket 5 is pivotally moved rearwardly by itself. Also, the pilot pressure is applied to each of the ports 24 and 25 but the spool 18 is moved leftwardly in FIG. 6 by the biasing force of the spring 23 to allow the two ports 19 and 20 to communicate with each other, when the boom 3 is pivotally moved upwardly and at the same time the bucket 5 is pivotally moved rearwardly. With the spool 18 being moved leftwardly in FIG. 6 as aforesaid, the pressure of the hydraulic fluid higher than the pressure regulated by the pressure reducing valve 48 is not produced at the port 41 of the cylinder 14, even if the piston 16 moved in sliding motion in the cylinder 14, so that the change-over valve 44 is in a closed position. As a result, no displacement of the piston 28 of the pressure producing means 26 occurs and, consequently, no pressure is produced in the output port 32 thereof. When the piston 16 is moved rightwardly in the cylinder 14 in FIG. 6 at this time, the hydraulic fluid discharged from the chamber 21 on the rod side is smaller in quantity than the hydraulic fluid introduced into the chamber 22 on the bottom side, so that the difference between the two quantities is made up for by a supply from the auxiliary pump 45. Conversely, when the piston 16 is moved leftwardly, the hydraulic fluid discharged from the chamber 22 on the piston side is larger in quantity than the hydraulic fluid introduced into the chamber 21 on the rod side, so that excess hydraulic fluid is discharged via the port 19 and pressure reducing valve 48 to a tank.

When the operation performed only involves upward pivotal movement of the boom 3, the pilot pressure is applied to the port 24 of the change-over valve 17 and the spool 18 is moved rightwardly in FIG. 6, to cut off communication between the two ports 19 and 20. Displacement of the piston 16 leftwardly in the cylinder 17 at this time produces a pressure in the chamber 22 on the port side of the cylinder 14, to thereby switch the change-over valve 44 to the open position, so that the pressure produced in the chamber 22 on the piston side urges the piston 28 of the pressure producing means 26 to move leftwardly in the cylinder 27 in FIG. 6, to thereby contract the spring 35. This urges the spool 33 to move leftwardly in FIG. 6, to close the tank port 31 and bring the pump port 30 into communication with the output port 32, so that a pilot pressure P is produced at the output port 32. The pilot pressure P is led via the hydraulic fluid passage 39 to the spring chamber 40, so that the pressure P urges the spool 33 to return rightwardly in FIG. 6. Thus, the pressure P is adjusted such that the biasing force of the spring 35 becomes equal to the sum of the force of the pressure P and the biasing force of the spring 36. Stated differently, if the displacement of the spring 35, the spring constant of the spring 35, the sectional area of the spool 33 and the biasing force of the spring 36 are denoted by X, K, S and f, respectively, then the following relation holds:

$$PS+f=KX$$

Therefore, $P=(K/S)X-(f/S)$

The displacement of the spring 36 is very small in amount so that the force f is substantially constant. Also, the spring constant K and the sectional areas are constant so that the pressure P is proportional to the displacement X. Therefore, the value of the pressure P is substantially proportional to the position of the piston 28 of the pressure producing means 26 or the displacement of the piston 16 of the cylinder 14.

When the upward pivotal movement of the boom 3 is interrupted during the operation of only moving the boom 3 pivotally upwardly, the pilot pressure ceases to act on the port 24 of the change-over valve 17 so that the spool 18 is urged by the biasing force of the spring 23 to move leftwardly in FIG. 6, to bring the two ports 19 and 20 into communication with each other. This switches the pressure reducing valve 48 to an open position, so that the pressure in the chamber 22 of the cylinder 14 on the piston side is reduced to a low level which is regulated by the pressure reducing valve 48. This switches the change-over valve 44 to the closed position. As a result, the hydraulic fluid disposed rightwardly of the piston 28 in the cylinder 27 of the pressure producing means 26 is discharged to the tank via the change-over valve 44 and the piston 28 is returned to the right end of the cylinder 27 by the biasing force of the spring 35. The spool 33 is moved rightwardly by the biasing force of the spring 36 to bring the output port 32 into communication with the tank, so that no pressure is produced at the outlet port 32.

The bucket detecting means is substantially of the same construction as the boom detecting means 55 and the description thereof will be omitted.

Figure 7:
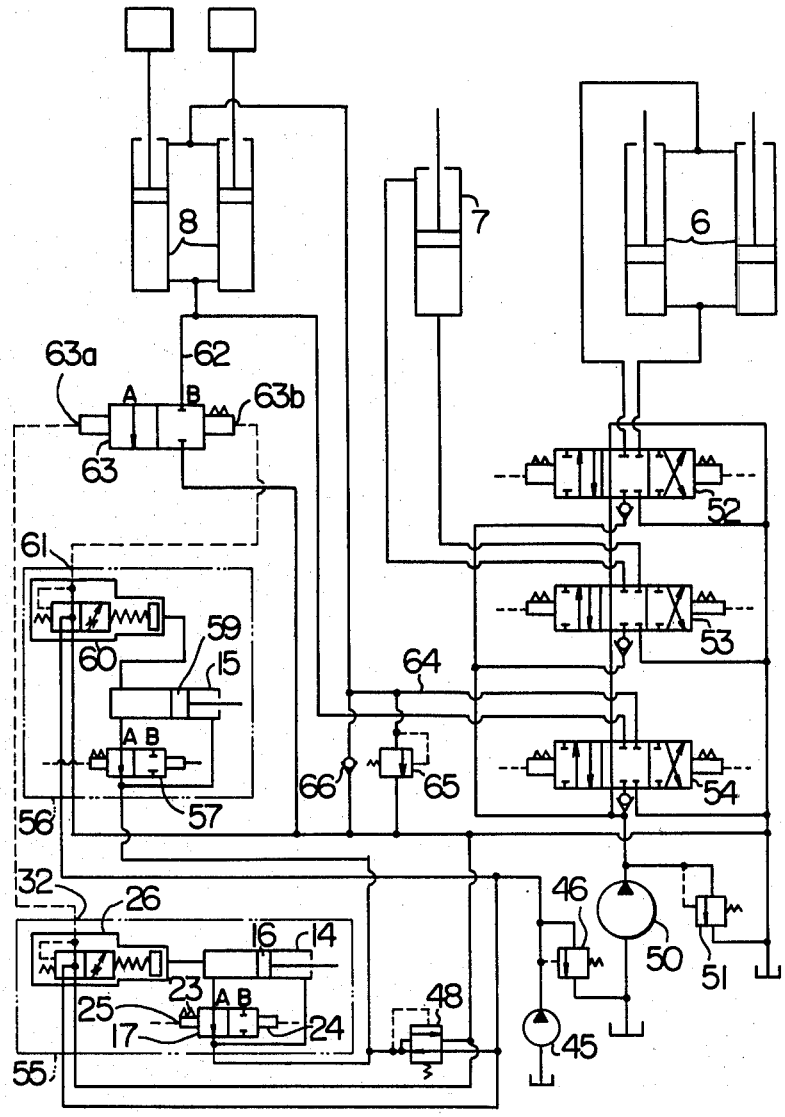
FIG. 7 is a diagram of a hydraulic fluid circuit of the excavator shown in FIG. 5.

FIG. 7 is a circuit diagram for hydraulic fluid of the excavator according to the invention, wherein a hydraulic pump 50 has a relief valve 51 connected thereto. A boom operating valve 52, an arm operating valve 53 and a bucket operating valve 54 are mounted between the hydraulic pump 50 on one hand and the boom cylinders 6, arm cylinder 7 and bucket cylinders 8, respectively, on the other. Bucket detecting means 56 comprises a change-over valve 57, a piston 59 fitted in the cylinder 15, and pressure producing means 60 formed with an output port 61. A conduit 62 connects the piston side of the bucket cylinders 8 to the tank and has mounted therein a control valve 63 having a pilot pressure port 63*a* connected to the output port 32 of the boom detecting means 55 and a pilot pressure port 63*b* connected to the output port 61 of the bucket detecting means 56. A conduit 64 connects the bucket operating valve 54 to the rod side of the bucket cylinders 8 and has an overload relief valve 65 and a check valve 66 mounted between the conduit 64 and the tank. The change-over valve 44 shown in FIG. 6 and a change-over valve interposed between the cylinder 15 and the pressure producing means 66 are not shown in FIG. 7.

Operation of the excavator according to the invention will now be described by referring to FIGS. 5–8. The bucket 5 is pushed out horizontally from position I or excavation initiating position shown in FIG. 5 to the lower horizontal posture position II shown in FIG. 8 in dash-and-dot lines, and then the bucket cylinders 8 are expanded to move the bucket 5 pivotally rearwardly to scoop earth, thereby moving the bucket 5 to the lower vertical posture position III shown in FIG. 8 in solid lines. Then the boom cylinders 6 are expanded. This switches the change-over valves 17 and 57 from position A or open position to position B or closed position. Upward pivotal movement of the boom 3 moves the piston 16 leftwardly in FIG. 7 so that a pressure substantially proportional to the amount of displacement of the piston 16 is produced at the output port 32 and acts on the pilot pressure port 63*a*. As a result, a spool of the control valve 63 moves toward position A or open position a distance substantially proportional to the pressure from the output port 32 or the amount of displacement of the piston 16 in the cylinder 14. The hydraulic fluid on the piston side of the bucket cylinders 8 is discharged through the control valve 63 to the tank by the weight of the bucket itself and the weight of the earth scooped thereby. At this time, hydraulic fluid is supplied from the tank via the check valve 66 to the rod side of the bucket cylinders 8, to contract the bucket cylinders 8 and move the bucket pivotally forwardly. Simultaneously as the bucket 5 is pivotally moved forwardly, the piston 59 in the cylinder 15 moves leftwardly in FIG. 7 and a pressure substantially proportional to the amount of displacement of the piston 59 is supplied to the pilot pressure port 63*b* from the output port 61. As a result, the spool of the control valve 63 is urged to move toward position B or closed position, and the control valve 63 is closed as the pressure from the output port 61 becomes equal in value to the pressure from the output port 32. When the control valve 63 moves to position B, outflow of hydraulic fluid from the piston side of the bucket cylinders 8 ceases. The series of operations described hereinabove ensure that the bucket 5 is pivotally moved forwardly as its level rises with the pivotal upward movement of the boom 3. Thus, the bucket 5 can be automatically kept in a predetermined posture or vertical posture while being moved from the lower vertical posture position III to the upper vertical posture position IV shown in dash-and-dot lines in FIG. 8 by the pivotal upward movement of the boom 3.

When the bucket 5 has reached the upper vertical posture position IV and is ready for dumping the earth, the bucket cylinders 8 are contracted to move the bucket 5 pivotally forwardly. As the bucket 5 is pivotally moved, the piston 59 in the cylinder 15 moves leftwardly in FIG. 7. Since the change-over valve 57 is in open position, however, no pressure is produced at the output port 61 of the pressure producing means 60, so that no pressure is applied to the pilot pressure port 63*a* and the control valve 63 remains closed. This makes it possible pivotally to move the bucket 5 forwardly at a speed commensurate with the amount of operation of the bucket operating valve 54. When the bucket 5 is pivotally moved rearwardly from the position V shown in FIG. 8 in broken lines in which earth dumping is completed, the control valve 63 still remains closed because no pressure is produced at the output port 61 due to the change-over valve 57 being open. This enables the bucket 5 to be pivotally moved rearwardly at a speed commensurate with the amount of operation of the bucket operating valve 54.

It will be noted that when the bucket 5 is of the bottom-dump type, there is no need to pivotally move the bucket 5 and instead the bottom of the bucket 5 has only to be opened while in the position V.

After the bucket 5 has been restored to the position IV following completion of earth dumping, it is returned to the excavation initiating position or horizontal posture position I. To this end, the boom 3 is pivotally moved downwardly. At this time, no pressure is produced at the output port 32 of the pressure producing means 26 and at the output port 61 of the pressure producing means, so that the control valve 63 still remains closed and the bucket 5 does not pivotally move. In other words, when the boom 3 is pivotally moved downwardly, the angle formed by the arm 4 and the bucket 5 remains substantially at the same as that formed when the bucket 5 is in the position IV, so that as the boom 3 is pivotally moved to the position shown in solid lines, the bucket 5 is moved to the position II in which the angle formed by the arm 4 and the bucket 5 is substantially the same as that formed when the bucket 5 is in the position IV. Contraction of the arm cylinder 7 with the bucket 5 in the position II gradually reduces the angle formed by the arm 4 and the bucket until the bucket 5 reaches the position I. It will therefore be understood that the bucket 5 can be moved from position IV to position I without actuating the bucket operating valve. Usually, the boom 3 is operated directly to move the bucket 5 from position IV to position I without passing through position II, but in this case the bucket 5 can be moved to position I also without actuating the bucket operating valve 54 for the same reason mentioned above.

When it is desired to pivotally move the boom 3 upwardly and pivotally move the bucket 5 rearwardly, the pilot pressures are applied to the two ports 24 and 25 of the change-over valve 17. Since the change-over valve 17 is in open position due to the biasing force of spring 34, however, no pressure is produced at the output port 32. Also, since the pilot pressures are applied to the two pilot pressure ports of the change-over valve 57, the change-over valve 57 is in open position due to the biasing force of its spring and no pressure is produced at the output port 61. Thus, the control valve 63 remains closed and allows rearward pivotal movement of the bucket 5 to take place. In other words, it is possible to pivotally move the boom 3 upwardly and at the same time pivotally move the bucket 5 rearwardly. One of the problems described as being experienced in the prior art or the third problem described above, to be more specific, is not raised in the excavator according to the invention.

In the embodiment shown and described hereinabove, the cylinder 14 is connected to the pressure producing means 26 by the conduit 43 as shown in FIG. 6. It is to be understood that the cylinder 14 may be formed integrally with the pressure producing means 26. However, the use of the conduit 43 for communicating the cylinder 14 with the pressure producing means 26 enables the pressure producing means 26 to be installed in a suitable position separately from the cylinder 14 or on the boom 3, for example. It is also to be understood that the change-over valve 44 may be replaced by a throttle valve. In the embodiment shown and described, the change-over valve 17 is disposed on the bottom side of the cylinder 14 and the conduit 43 communicates the chamber 22 on the piston side with the pressure producing means 26 while the cylinder 14 is mounted on the upper portion of the boom 3. However, it is possible to cause a pilot pressure commensurate with the pivotal upward movement of the boom 3 to be produced at the output port 32 of the pressure producing means 26, even if the change-over valve 17 is disposed on the rod side of the cylinder 14 and the chamber 21 on the rod side of the cylinder 14 is connected to the pressure producing means 26 while the cylinder 14 is mounted on the lower portion of the boom 3. It is also be understood that the cylinders 14 and 15 may be respectively mounted on the boom 3 and bucket 5 through links. By making the mounting positions of the cylinders 14 and 15 adjustable or by varying the dimensions and spring constant of the spring 35 of the pressure producing means 26, it is possible freely to control the relationship between the position of the boom 3 and the position of the bucket 5. In the embodiment shown and described hereinabove, pilot hydraulic pressures are produced by the cylinders 14 and 15. It is to be understood, however, that the pilot pressures are not limited to hydraulic pressures and that pressures other than hydraulic pressures or pneumatic pressures, for example, may be used instead.

Figure 9:
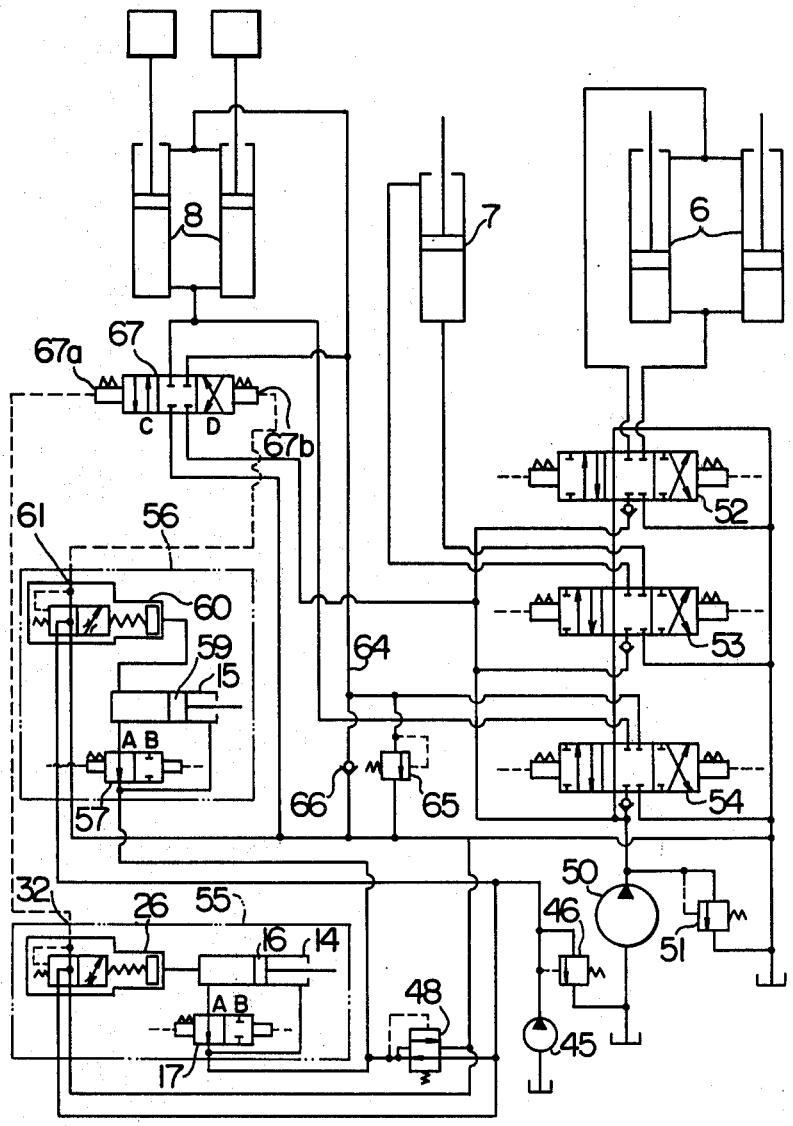
FIG. 9 is a diagram of a modification of the hydraulic fluid circuit shown in FIG. 7.

FIG. 9 shows a modification of the hydraulic fluid circuit of the excavator according to the invention. In the diagram of FIG. 9, parts similar to those shown in FIG. 7 are designated by like reference characters. In the circuit shown in FIG. 9, a control valve 67 is used in place of the control valve 63 shown in FIG. 7. When the control valve 67 is in position C or a normal flow position, the rod side of the bucket cylinders 8 communicates with the hydraulic pump 50 and the piston side of the bucket cylinders 8 communicate with the tank. When the control valve 67 is in position D or a reverse flow position, the piston side of the bucket cylinders 8 communicates with the hydraulic pump 50 and the rod side of the hydraulic cylinders 8 communicates with the tank. The control valve 67 is formed with pilot pressure ports 67*a* and 67*b* connected to the output ports 32 and 61 respectively.

Operation of the excavator provided with the hydraulic fluid circuit shown in FIG. 9 will be described. The bucket 5 is pushed out horizontally from the position I or the excavation initiating position shown in FIG. 5 to the lower horizontal posture position II shown in FIG. 8 in dash-and-dot lines and then the bucket cylinders 8 are expanded to move the bucket 5 pivotally rearwardly so that the bucket 5 may scoop earth. This moves the bucket 5 to the lower vertical posture position III shown in FIG. 8 in solid lines. Then the bucket cylinders 8 are expanded to switch the change-over valves 17 and 57 to closed positions. Upward pivotal movement of the boom 3 moves the piston 16 leftwardly in FIG. 7 so that a pressure substantially proportional to the amount of displacement of the piston 16 is produced at the output port 32 and acts on the pilot pressure port 67*a*. As a result, a spool of the control valve 67 moves toward position C or normal flow position a distance substantially proportional to the pressure from the output port 32 or the amount of displacement of the piston 16. The hydraulic fluid delivered from the hydraulic pump 50 is supplied to the rod side of the bucket cylinders 8 as the hydraulic fluid on the piston side is discharged and returned to the tank by the weight of the bucket 5 and the earth scooped thereby, so that the bucket cylinders 8 are contracted and the bucket 5 is pivotally moved forwardly. As the bucket 5 is moved pivotally forwardly, the piston 59 in the cylinder 15 moves leftwardly in the figure and a pressure substantially proportional to the amount of displacement of the piston 59 is supplied from the output port 61 to the pilot pressure port 67*b*. As a result, the spool of the control valve 67 is urged to move toward position D or reverse flow position, and the control valve 67 moves to a neutral position as the pressure from the output port 61 becomes equal in value to the pressure from the output port 32, thereby interrupting the movement of the bucket cylinders 8. If the bucket 5 is pivotally moved forwardly more than is necessary at this time, then the pressure from the output port 61 becomes higher than the pressure from the output port 32, so that the control valve 67 moves to position D and the hydraulic fluid delivered by the hydraulic pump 50 is supplied to the piston side of the bucket cylinders 8. As a result, the bucket cylinders 8 are expanded and the bucket 5 is pivotally moved rearwardly to correct its posture. The series of operations described hereinabove ensures that the bucket 5 is pivotally moved forwardly as its level rises with the pivotal upward movement of the boom 3. Thus, the bucket 5 can be automatically kept in a predetermined posture or a vertical posture while being moved from the lower vertical posture position III to the upper vertical posture position IV shown in FIG. 8 in dash-and-dot lines by the pivotal upward movement of the boom 3.

The operation of contracting the bucket cylinders 8 to pivotally move the bucket 5 from the position IV in which the bucket 5 is ready for earth dumping to the position V in which earth dumping is completed, operation of moving the bucket 5 from the earth dumping completion position V to the standby position IV by moving same pivotally rearwardly, operation of moving the bucket 5 back to the horizontal posture position I or excavation initiating position from the standby position IV through position II and operation of pivotally moving the boom 3 to move the bucket 5 pivotally rearwardly to scoop earth again are substantially similar to those which have been described hereinabove by referring to the hydraulic fluid circuit shown in FIG. 7. More specifically, in performing all of these operations, no pilot pressure is produced at the output ports 32 and 61 of the pressure producing means 26 and 60, respectively, and the control valve 67 is in neutral position, so that it is possible to operate the boom 3 and bucket 5 independently of each other at a speed commensurate with the amount of operation of the boom operating valve 52 and bucket operating valve 54.

In the hydraulic fluid circuit shown in FIG. 9, the hydraulic fluid delivered by the hydraulic pump 50 is supplied to the rod side of the bucket cylinders 8 via the control valve 67 in normal flow position, in performing the operation of pivotally moving the boom 3 upwardly to move the bucket 5 from the lower vertical position III to the upper vertical position, so that the bucket 5 is positively moved forwardly by hydraulic pressure combined with its own weight and the weight of earth scooped thereby. If the bucket 5 moves forwardly more than is necessary in this operation, then the control valve 67 is moved to reverse flow position to supply hydraulic fluid to the piston side of the bucket cylinders 8, to adjust the posture of the bucket 5. Thus, the embodiment provided with the hydraulic fluid circuit shown in FIG. 9 offers the advantage that the bucket 5 can be automatically kept in a vertical position more readily than the first embodiment.

Figure 10:
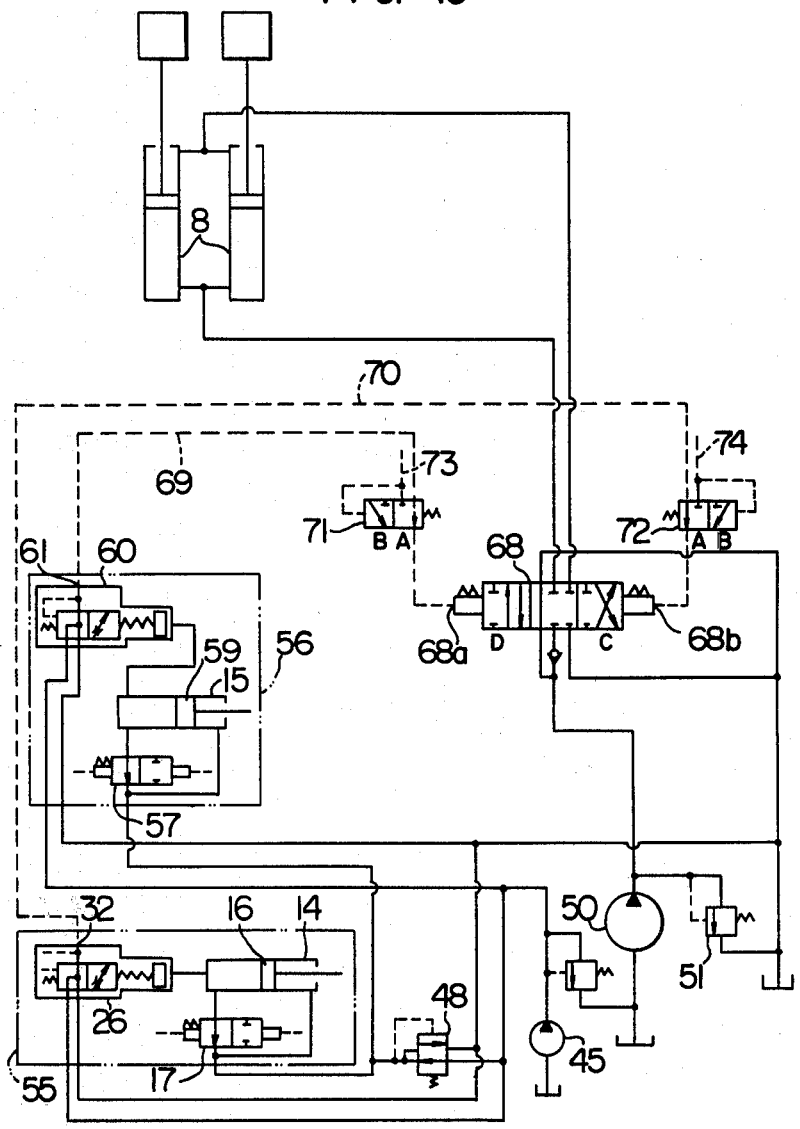
FIG. 10 is a diagram of a modification of the hydraulic fluid circuit shown in FIG. 9.

FIG. 10 shows a modification of the hydraulic fluid circuit shown in FIG. 9 of the excavator according to the invention. In FIG. 10, parts similar to those shown in FIG. 9 are designated by like reference characters and some of them are omitted. In FIG. 10, a control valve 68 functioning concurrently as a bucket operating valve is formed with pilot pressure ports 68*a* and 68*b* connected to the output ports 32 and 61 via conduits 69 and 70 respectively. The conduits 69 and 70 have selection valves 71 and 72, respectively, mounted therein which are normally in position A in which the valves 71, 72 connect the conduits 69 and 70 to the port 58*b*. When hydraulic fluid is supplied to bucket command pilot pressure conduits 73 and 64, the selection vales 71 and 72 are switched to position B in which the valves connect the conduits 73 and 74 to the ports 68*a* and 68*b* respectively.

In this form of hydraulic fluid circuit, the absence of pilot pressure from the pilot pressure conduits 73 and 74 which are produced by the action of the operator keeps the selection valves 70 and 71 in position A, and the control valve 68 is controlled by the pressures from the output ports 32 and 61. Thus, the hydraulic fluid circuit shown in FIG. 10 can perform the same operation as the hydraulic fluid circuit shown in FIG. 9. When pilot pressures are supplied by the action of the operator to the pilot pressure conduits 72 and 73, the selection valve 70 and 71 are switched to position B, and the control valve 78 is controlled by the pilot pressures in the pilot pressure conduits 72 and 73. Thus, it is possible to contract the bucket cylinders 8 as desired.

Figure 11:
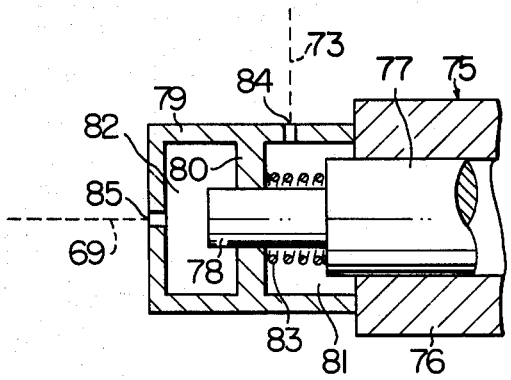
FIG. 11 is a sectional view of a modification of the control valve means of the hydraulic fluid circuit shown in FIG. 10.

FIG. 11 is a sectional view of one end portion of a control valve 75 which is a modified form of control valve 68 shown in FIG. 10. The control valve 75, which combines the function of control valve 68 with that of selection valves 71 and 72, comprises a valve body 76, a spool 77 slidably fitted in the valve body 76, a minor diameter portion 78 of the spool 77 extending from one end thereof, a spool pressure bearing section 79 disposed at one end of the valve body 76, a partition plate 80 dividing the pressure bearing section 79 into a spring chamber 81 and a minor diameter portion chamber 82 and having the minor diameter portion 78 slidably extending therethrough, a spring 83 mounted between the spool 77 and the partition plate 80, and ports 84 and 85 formed in the spring chamber 81 and minor diameter portion 82, respectively. The ports 84 and 85 are connected to pilot pressure conduits 73 and 69, respectively. The control valve 75 has another end portion of similar construction as described hereinabove.

In the control valve 75, when no pilot pressure is applied to the pilot pressure conduit 73 (74), the spool 77 is controlled by the pressure in the pilot pressure conduit 69 (70); when pressure is applied to the pilot pressure conduit 73 (74), the spool 77 is controlled by the pressure in the conduit 73 (74). Thus, the control valve 75 dispenses with the selection valves 71 and 72 and the conduits connecting the selection valves 71 and 72 to the ports 68*a* and 68*b*, respectively, thereby contributing to simplification of the construction.

Figure 12:
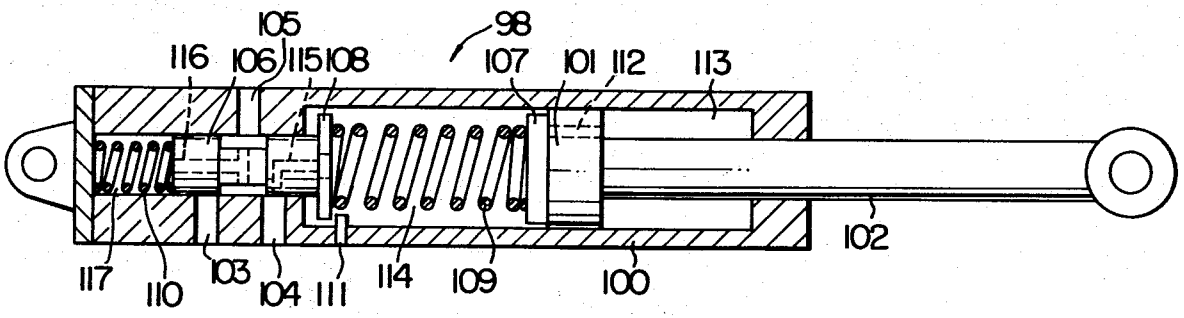
FIG. 12 is a sectional view of a modification of the boom detecting means shown in FIG. 6.
Figure 13:
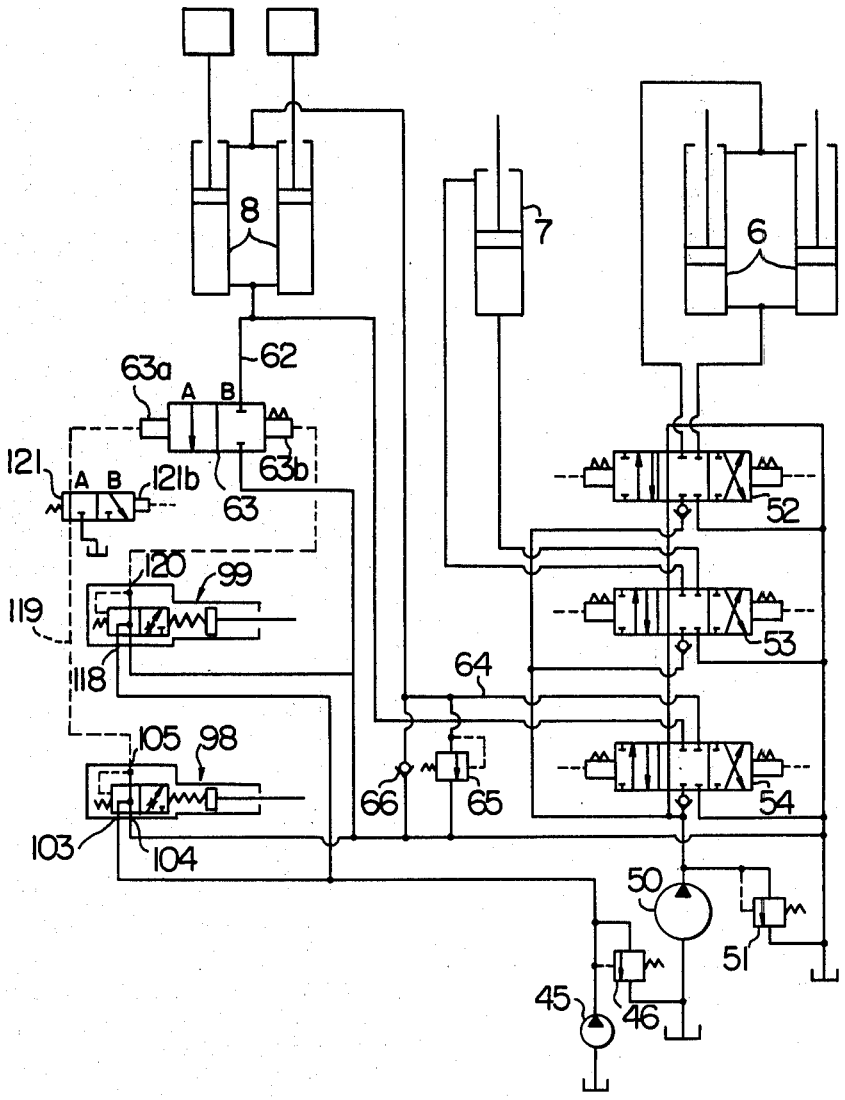
FIG. 13 is a diagram of a hydraulic fluid circuit of the excavator incorporating therein the boom detecting means shown in FIG. 12.

FIG. 12 is a sectional view of boom detecting cylinder means 98 which may be used in place of the boom detecting means 55, when the boom detecting cylinder means 98 is used, bucket detecting cylinder means 99 of similar construction may be used in place of the bucket detecting means 56. In this case, the cylinders 14 and 15 shown in FIG. 5 are replaced by the boom detecting cylinder means 98 and bucket detecting cylinder means 99, respectively. In FIG. 12, the boom detecting cylinder means 98 comprises a cylinder 100, a piston 101 slidably fitted in the cylinder 100, a rod 102 connected to the piston 101, a pump port 103, a tank port 104 and an output port 105 formed in the cylinder 100. The pump port 103 and tank port 105, as shown in FIG. 13, are connected to the auxiliary pump 45 and tank respectively, with a spool 106 being slidably fitted in the cylinder 100, and spring seats 107 and 108 slidably mounted in the cylinder 100. A spring 109 is mounted at opposite ends thereof between the spring seats 107 and 108, with a spring 110 mounted between the spool 106 and one end of the cylinder 100. A stopper 111 is mounted in the cylinder 100 for regulating the rightward movement of the spool 106 in the cylinder 100, with a hydraulic fluid passage 112 communicating a chamber 113 on the rod side with a spring chamber 114. A hydraulic fluid passage 115 communicates the spring chamber 114 with the tank port 104 and a hyraulic fluid passage 116 communicates the output port 105 with a spring chamber 117.

In the boom detecting cylinder means 98 of the aforesaid construction, when the distance between the end surface of the piston 101 and the end surface of the spool 106 is greater than the sum of the natural length of the spring 109 and the thicknesses of the springs seats 107 and 108, the spool 106 is urged by the biasing force of the spring 110 to move rightwardly in the figure so that the output port 105 communicates with the tank port 104. Thus, no pilot pressure is produced at the output port 105. When the aforesaid distance becomes smaller than the sum of the natural length of the spring 109 and the thicknesses of the spring seats 107 and 108, the spring 109 is compressed and urges the spool 106 to move leftwardly in the figure by its biasing force, to close the tank port 104 and bring the pump port 103 into communication with the output port 105. Thus, a pilot pressure P is introduced through the hydraulic fluid pressure 116 into the spring chamber 117 so that the pressure P exerts a force on the spool 106 tending to move same rightwardly in the figure. Accordingly, the pressure P is adjusted in such a manner that the biasing force of the spring 109 becomes equal to the sum of the force exerted by the pressure P and the biasing force of the spring 110. If the amount of displacement of the spring 109, the spring constant of the spring 109, the sectional area of the spool 106 and the biasing force of the spring 110 are denoted by X, K, S and f respectively, then the following relation holds:

$$PS+f=KX$$

Therefore, $P=(K/S)X-(f/S)$.

The amount of displacement of spring 110 being very small, the force f is substantially constant. The spring constant K and sectional area S being constant, the pressure P is proportional to the amount of displacement X. Therefore, the value of pressure P is commensurate with the position of piston 101 or the amount of constraction of the detecting cylinder means 98.

FIG. 13 shows a hydraulic fluid circuit of the excavator including the boom detecting cylinder means 98 and bucket detecting cylinder means 99 of the construction shown in FIG. 12, in which parts similar to those shown in FIG. 7 are designated by like reference characters. As aforesaid, the hydraulic pump 50 has the relief valve 51 connected thereto. The boom operating valve 52, arm operating valve 53 and bucket operating valve 54 are mounted between the hydraulic pump 50 and the boom cylinders 6, arm cylinder 7 and bucket cylinders 8 respectively. The auxiliary pump 45 has the relief valve 46 connected thereto and is connected to the pump ports 103 and 118 of the boom detecting cylinder means 98 and bucket detecting cylinder means 99, respectively. The conduit 62 connects the piston side of the bucket cylinders 8 to the tank and has mounted therein the control valve 63 having the pilot pressure port 63*a* connected to the output port 105 of the boom detecting cylinder means 98 via a conduit 119 and the pilot pressure port 63*b* connected to an output port 120 of the bucket detecting cylinder means 99. A change-over valve 121 mounted in the conduit 119 is normally disposed in position A in which the pilot pressure port 63*a* is connected to the output port 105. When a pilot pressure is applied to a pilot pressure port 121*b* of the change-over valve 121, the valve 121 is switched to position B in which the pilot pressure port 63*a* is connected to the tank. The conduit 64 connecting the bucket operating valve 54 to the rod side of the bucket cylinders 8 has the overload relief valve 64 and check valve 66 mounted between the conduit 64 and tank.

Operation of the excavator having the hydraulic fluid circuit shown in FIG. 13 will be described. The bucket 5 is pushed out horizontally from the position I or the excavation initiating position shown in FIG. 5 to the lower vertical posture position II shown in FIG. 8 in dash-and-dot lines, and then the bucket cylinders 8 are expanded to move the bucket pivotally rearwardly to scoop earth. This moves the bucket 5 to the lower vertical posture position III shown in solid lines in FIG. 8. When the bucket 5 is in this position, no pressure is produced at the output ports 105 and 120 of the boom detecting cylinder means 98 and bucket detecting cylinder means 99, respectively. However, the pistons of the cylinder means 98 and 99 have strokes which are such that if the cylinder means 98 and 99 show any contraction at the time a pressure is produced at the output ports 105 and 120. When the boom cylinders 6 are expanded to move the boom 3 pivotally upwardly with the bucket 5 in the lower vertical posture position III, hydraulic fluid is supplied from the output port 105 to the port 63*a* of the control valve 63 to move the spool of the control valve 63 toward position A or open position a distance substantially proportional to the pressure from the output port 105 or the amount of contraction of the boom detecting cylinder means 98. Thus, the hydraulic fluid on the piston side of the bucket cylinders 8 is discharged through the control valve 63 to the tank by the weight of the bucket 5 itself and the weight of the earth scooped thereby. At this time, hydraulic fluid is supplied from the tank via the check valve 66 to the rod side of the bucket cylinders 8, so as to contract the bucket cylinders 8 and move the bucket pivotally forwardly. Simultaneously as the bucket 5 pivotally moved forwardly, the bucket detecting cylinder means 99 is contracted and a pressure commensurate with the amount of contraction of cylinder means 99 is supplied to the port 63*b* from the output port 120. Thus, the control valve 63 has its spool moved in a direction in which the valve is closed, and as the pressure from the output port 120 becomes equal in value to the pressure from the output port 105, the control valve 63 is disposed in position B to interrupt the flow of hydraulic fluid from the piston side of the bucket cylinders 8. The series of operations described hereinabove ensure that the bucket 5 is pivotally moved forwardly as its level rises with the pivotal upward movement of the boom 3. Thus, the bucket 5 can be automatically kept in a predetermined posture while being moved from the lower vertical position III to the upper vertical position IV shown in FIG. 8 in dash-and-dot lines by the pivotal upward movement of the boom 3.

Figure 8:
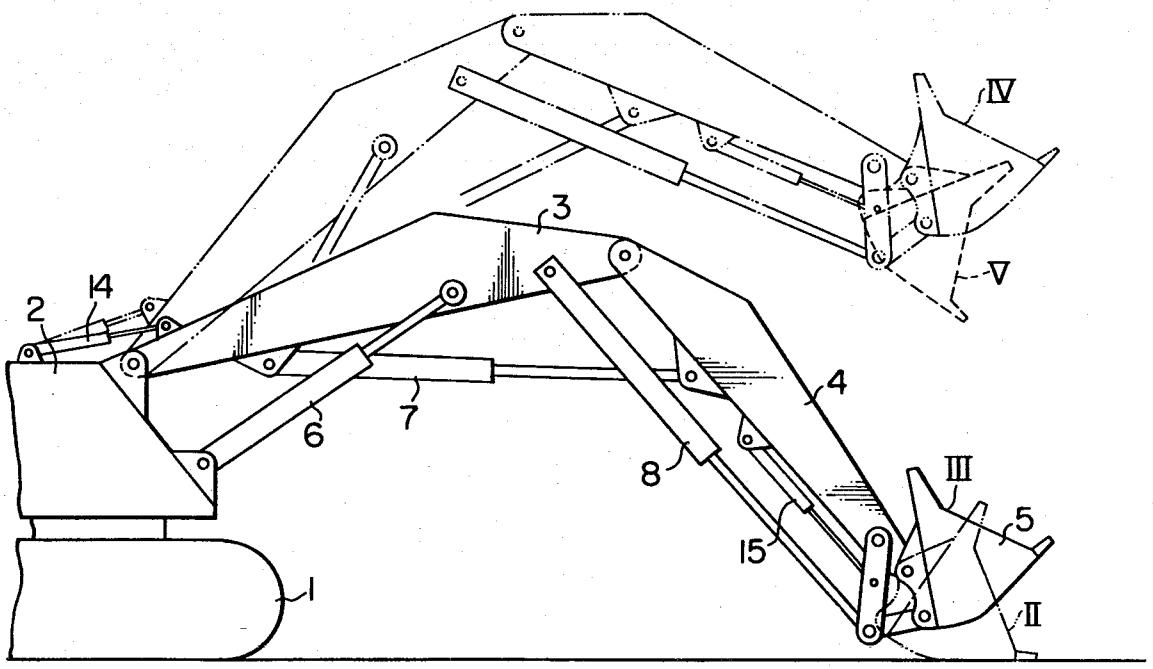
FIG. 8 is a side view of the excavator shown in FIG. 5, showing the excavator performing operations.

When the bucket 5 has moved to the upper vertical position IV and is ready for earth dumping, the bucket 5 is pivotally moved to the position V shown in FIG. 8 in broken lines. At this time, the bucket detecting cylinder means 99 is contracted as the bucket 5 is pivotally moved forwardly, and a pressure proportional to the amount of contraction of the cylinder means 99 is supplied from the output port 120 to the port 63*b* of the control valve 63, to keep the valve 63 in closed position. This enables the bucket cylinders 8 to be contracted at a speed commensurate with the amount of operation of the bucket operating valve 54.

In case the operator makes an error and operates the bucket operating valve 54 in such a manner that the bucket cylinders 8 are expanded when the bucket 5 in the upper vertical position IV, the pressure at the output port 120 shows a slight drop as the cylinder means 99 slightly expands. This causes a discrepancy to occur in pressure between the ports 53*a* and 63*b* of control valve 63, thereby moving the spool of valve 63 toward open position. As a result, the hydraulic fluid delivered by the hydraulic pump 50 is discharged to the tank via the valve 63. In this fashion, the bucket 5 is prevented from pivotally moving rearwardly when it is in position IV and the danger of the earth being dumped into the cab can be avoided.

To return the bucket 5 from position V to position IV following earth dumping, one has only to switch the bucket operating valve 54 in a direction in which the bucket cylinders 8 are expanded. That is, before the bucket 5 is returned to position IV, the pressure at the output port 120 is higher than the pressure at the output port 105 and the control valve 63 is in closed position, so that the bucket cylinders 8 can be expanded. However, movement of the bucket 5 to position IV causes the pressure at the output port 120 to become equal to the pressure at the output port 105. Further pivotal rearward movement of the bucket 5 makes the pressure at the output port 105 higher and moves the control valve 63 to open position, so that the bucket 5 remains stationary in position IV.

Then the boom 3 is pivotally moved downwardly to return the bucket 5 from position IV to position I. This reduces the pressure at the output port 105 but increases the pressure at the output port 120, so that the control valve 63 is kept in closed position and the bucket 5 is prevented from pivotally moving. Therefore, even if the boom 3 is pivotally moved downwardly, the angle formed by the arm 4 and bucket 5 remains the same as the corresponding angle formed when the bucket 5 is in position IV, and the bucket 5 moves to position II when the boom 3 is pivotally moved downwardly to the solid line position shown in FIG. 8. If the arm cylinder 7 is contracted at this time, then the angle formed by the arm 4 and bucket 5 is gradually reduced but the bucket 5 is not brought into contact with the arm 4 because the angle formed by the arm 4 and bucket 5 when the latter is in position II is increased. Thus, the bucket 5 can be returned from position IV to position I by merely moving the arm 4 and boom 3 pivotally. It will be understood that the same situation occurs when the bucket 5 is directly moved from position IV to position I without passing through position II.

When it is necessary to further move the bucket 5 pivotally rearwardly when it is in position IV, the end can be attained by merely causing a pilot pressure to act on the port 121*b* of change-over valve 121. In this case, the change-over valve 121 is switched to position B and the port 63*a* communicates with the tank. This moves the control valve 63 to closed position in which the bucket cylinders 8 can be expanded to pivotally move the bucket 5 further rearwardly.

Figure 14:
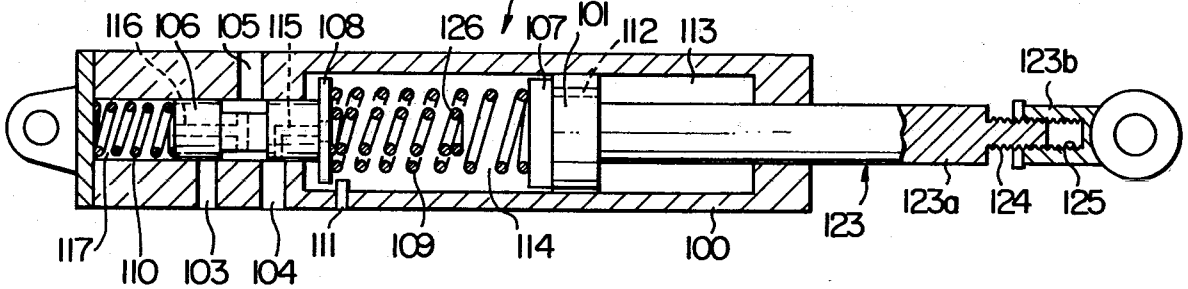
FIG. 14 is a sectional view of a modification of the boom detecting means shown in FIG. 12.

FIG. 14 shows in a sectional view a modification of the boom detecting cylinder means 98 shown in FIG. 12, in which parts similar to those shown in FIG. 12 are designated by like reference characters. In the boom detecting cylinder means 122 shown in the figure, a rod 123 is composed of two portions 123*a* and 123*b*, and a male screw 124 is formed at the end portion of the rod portion 123*a* and threadably engaged in a female screw 125 formed in the rod portion 123*b*. Thus, the overall length of the rod 123 can be adjusted as desired. The bucket detecting cylinder means corresponding to the bucket detecting cylinder means 99 may have a similar construction. This enables the relationship between the position of the boom 3 and the posture of bucket 5 to be controlled as desired. Also, a spring 126 of a smaller natural length than the spring 109 is mounted in the cylinder means 122. The use of spring 126 enables the pressure at the output port 105 to be changed nonlinearly. This also makes it possible to cause the bucket 5 to pivotally move forwardly a suitable amount as the boom 3 is pivotally moved upwardly, so that the bucket 5 can be automatically made to assume an earth dumping standby posture. This contributes to increased operation efficiency because earth dumping is facilitated.

From the foregoing description, it will be appreciated that the present invention offers many advantages. In the excavator according to the invention, the bucket 5 can be automatically kept in a predetermined posture when it is moved upwardly after scooping earth. Also, when the operation of pivotally moving the boom 3 upwardly and at the same time moving the bucket 5 pivotally rearwardly is performed, the third problem encountered in the prior art discussed in the background of the invention can be avoided. Moreover, when the bucket 5 is returned to the excavation initiating position following completion of earth dumping, it is not necessary to pivotally move the bucket 5, thereby facilitating performing of the operation and increasing operation efficiency. Forces produced by the cylinders of boom detecting means and bucket detecting means and exerted on the boom 3 and other parts are so small that it is not necessary to increase the strength of the boom 3 and other parts and the cylinders can be mounted in a simple structure. Thus, the weight and cost of production can be reduced. The strokes of the pistons of the cylinders and the diameters of the cylinders can be reduced. This eliminates limitations which would otherwise be placed on the mounting structure of the cylinders, thereby contributing to reduced cost. In one preferred embodiment, means are provided for automatically preventing pivotal rearward movement of the bucket when the operator makes an error and pivotally moves the bucket rearwardly when the bucket is in a position sufficiently high to dump the earth. Thus, the excavator is very high in safety. When the bucket 5 is of the tilt-dump type, it is possible automatically to return the bucket 5 to the pre-dumping position merely by performing the operation of pivotally moving the bucket 5 rearwardly after it is pivotally moved forwardly to dump the earth. This is conductive to increased operation efficiency and reduced strain which is put on the operator.

What is claimed is:

1. An excavator comprising: a swivelling member mounted for swivelling motion on a travelling member; a boom pivotally moved by boom cylinders pivotally connected to said swivelling member; an arm pivotally moved by an arm cylinder pivotally connected to said boom; and a bucket pivotally moved by bucket cylinders pivotally connected to said arm; wherein the improvement comprises:

boom detecting means for detecting a pivotal displacement of the boom and producing a first pilot pressure substantially proportional to the detected pivotal displacement of the boom;

bucket detecting means for detecting a pivotal displacement of the bucket and producing a second pilot pressure substantially proportional to the detected pivotal displacement of the bucket;

control valve means including first and second valve switching pilot pressure ports;

first conduit means for introducing the first pilot pressure to the first valve switching pilot pressure port of said control valve means;

second conduit means for introducing the second pilot pressure to the second valve switching pilot pressure port of said control valve means; and said control valve means being connected to the bucket cylinders in a manner to allow a piston side of the bucket cylinders to be drained.

2. An excavator as claimed in claim 1, wherein said boom detecting means comprises a first cylinder means having a first piston displaced as said boom is pivotally moved upwardly, and a first pressure producing means producing the first pilot pressure substantially proportional to the displacement of the first piston, wherein said bucket detecting means comprises a second cylinder means having a second piston displaced as said bucket is pivotally moved, and a second pressure producing means producing the second pilot pressure substantially proportional to the displacement of the second piston, and wherein at least said boom detecting means comprises means for controlling the first pressure producing means in such a manner that the first pilot pressure is produced only when the boom is pivotally moved upwardly except when the bucket is pivotally moved by manipulation of an operator simultaneously as the boom is pivotally moved upwardly.

3. An excavator as claimed in claim 2, wherein at least one of the first and second pressure producing means comprises a cylinder, a piston slidably fitted in the cylinder, a pump port, a tank port and an output port formed in the cylinder, a spool slidably mounted in the cylinder, a first spring mounted between the piston and the spool, a second spring mounted between the cylinder and the spool, and a hydraulic fluid passage formed in the spool connecting the output port to a spring chamber in which the second spring is disposed.

4. An excavator as claimed in claim 1, wherein said control valve means comprises a control valve movable between a first position in which it allows the piston side of the bucket cylinders to communicate with a drain tank and a second position in which it interrupts the communication between the piston side of the bucket cylinders and the drain tank, said control valve being normally disposed in the second position but movable toward the first position when the first pilot pressure supplied to the first valve switching pilot pressure port is higher than the second pilot pressure supplied to the second valve switching pilot pressure port.

5. An excavator as claimed in claim 1, wherein said control valve means comprises a control valve movable between a first position for allowing the piston side of the bucket cylinders to communicate with a drain tank and at the same time allow the rod side of the bucket cylinders to communicate with a source of hydraulic pressure, a second position for allowing the piston side of the bucket cylinders to communicate with the source of hydraulic pressure and at the same time allow the rod side of the bucket cylinders to communicate with the drain tank, and a third position for interrupting all the aforesaid communications, said control valve being normally disposed in the third position but movable toward the first position when the first pilot pressure supplied to the first valve switching pilot pressure port is higher than the second pilot pressure supplied to the second valve switching pilot pressure port and movable toward the second position when the second pilot pressure is higher than the first pilot pressure.

6. An excavator as claimed in claim 5, wherein said control valve is a control valve functioning concurrently as a bucket operating valve, said control valve being operative, when a bucket operating pilot pressure produced by an operator is supplied thereto, by the bucket operating pilot pressure introduced to the first and second valve switching pilot pressure ports and being operative, when no bucket operating pilot pressure is produced, by the first and second pilot pressures introduced to the valve switching pilot pressure ports.

7. An excavator as claimed in claim 6, wherein said control valve means further comprises first and second selection valves connected to the first and second conduit means, respectively, and operative to introduce the bucket operating pilot pressures and the first and second pilot pressures to the first and second valve switching pilot pressure ports in the selection mode described.

8. An excavator as claimed in claim 6, wherein said control valve functioning concurrently as a bucket operating valve comprises a spool having minor diameter portions at opposite ends thereof, a valve body having spool pressure bearing sections at opposite ends thereof, a partition plate dividing each the spool pressure bearing section into a spring chamber and a minor diameter portion chamber and having the minor diameter portion slidably extending therethrough, and a spring mounted between the partition plate and the spool in the spring chamber, said minor diameter portion chambers being supplied with the first and second pilot pressures and said spring chambers being supplied with the bucket operating pilot pressures.

* * * * *